US011846453B2

(12) United States Patent
Porwal et al.

(10) Patent No.: US 11,846,453 B2
(45) Date of Patent: Dec. 19, 2023

(54) EVAPORATOR ASSEMBLIES AND HEAT PUMP SYSTEMS INCLUDING THE SAME

(71) Applicant: Rheem Manufacturing Company, Atlanta, GA (US)

(72) Inventors: Piyush Porwal, Montgomery, AL (US); Khurram Sajjad, Montgomery, AL (US); Harsh Patel, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 290 days.

(21) Appl. No.: 17/158,428

(22) Filed: Jan. 26, 2021

(65) Prior Publication Data

US 2022/0235978 A1 Jul. 28, 2022

(51) Int. Cl.
*F25B 30/02* (2006.01)
*F25B 39/02* (2006.01)

(52) U.S. Cl.
CPC ..... *F25B 30/02* (2013.01); *F25B 39/028* (2013.01); *F25B 2313/00* (2013.01); *F25B 2313/029* (2013.01)

(58) Field of Classification Search
CPC .... F25B 30/02; F25B 39/028; F25B 2313/00; F25B 2313/029; F25B 2500/09; F25B 39/02; F28D 1/04; F28D 2021/0064; F28D 2200/00
See application file for complete search history.

(56) References Cited

U.S. PATENT DOCUMENTS 3,741,290 A * 6/1973 Nenadal ..... F24F 13/20 62/262
4,660,390 A * 4/1987 Worthington ..... F24F 1/0043 62/309
4,977,756 A * 12/1990 Brock ..... F24F 6/04 261/106
6,202,782 B1 * 3/2001 Hatanaka ..... B60K 6/442 60/39.181
6,617,067 B1 * 9/2003 Tachihara ..... H01M 8/0631 261/157

(Continued)

FOREIGN PATENT DOCUMENTS

WO 2019050484 A1 3/2019

OTHER PUBLICATIONS

International Search Report and Written Opinion of PCT/US2022/013606 dated May 5, 2022.

*Primary Examiner* — Kun Kai Ma
(74) *Attorney, Agent, or Firm* — Eversheds Sutherland (US) LLP

(57) ABSTRACT

Disclosed herein are evaporator assemblies for heat pump systems. The evaporator units can comprise a housing defining an interior chamber, an air inlet and an air outlet. The air inlet and the air outlet can form an air flow path through the interior chamber, and an evaporator unit can be positioned within the interior chamber such that the air flow path contacts the evaporator unit. The air inlet having a semi-circular cross section through which air flows into the interior chamber, the semi-circular cross section having a straight edge and a curved edge. A velocity magnitude of the air flowing from the air inlet into contact with the evaporator unit can deviate less than 0.1 m/s from the average air velocity across the surface area of the evaporator.

19 Claims, 11 Drawing Sheets

(56) References Cited

U.S. PATENT DOCUMENTS

| | | | | |
|---|---|---|---|---|
| 2005/0039486 | A1* | 2/2005 | Knoll | F28D 9/0043 62/515 |
| 2006/0000227 | A1* | 1/2006 | Hyland | F24F 5/0035 62/235.1 |
| 2006/0154592 | A1* | 7/2006 | Wawzyniak | B60H 1/00685 454/121 |
| 2007/0187520 | A1* | 8/2007 | Hall | B60H 1/00514 236/12.12 |
| 2007/0261413 | A1* | 11/2007 | Hatamian | F24F 5/0042 62/93 |
| 2009/0032758 | A1* | 2/2009 | Stevenson | B60H 1/00692 251/248 |
| 2012/0018117 | A1 | 1/2012 | Yamada et al. | |
| 2018/0169669 | A1* | 6/2018 | Himmelmann | B01D 53/00 |
| 2019/0113243 | A1 | 4/2019 | Sato et al. | |
| 2020/0240433 | A1* | 7/2020 | Hoyt | F04D 17/16 |

* cited by examiner

EVAPORATOR ASSEMBLIES AND HEAT PUMP SYSTEMS INCLUDING THE SAME

FIELD OF THE DISCLOSURE

The present disclosure relates generally to evaporator assemblies and, in particular, to air inlets for evaporator assemblies.

BACKGROUND

Decreasing the energy consumption of water heaters can have a large impact on the energy usage of an overall household or other building. Some studies have found the water heater to be the second-most energy consuming appliance in a typical household, trailing only the heating and air conditioning system in the home. Particularly in heat pump water heater systems, increasing the heat transfer coefficient of the heat exchangers is desirable because increased efficiency of the heat pump will lead to increased efficiency of the water heater overall. When ambient air enters the heat pump to exchange heat with a thermal working fluid, a large portion of the heat transfer efficiency can be lost due to uneven distribution of air. Air recirculation and general turbulent flow can reduce the contact area of the heat exchanger that is available for heat transfer, thus reducing the heat transfer coefficient and efficiency of the system.

What is needed, therefore, are heat pump units that improve the flow of ambient air entering the heat pump to improve the heat transfer coefficient of the heat pump. The present disclosure addresses this need as well as other needs that will become apparent upon reading the description below in conjunction with the drawings.

BRIEF SUMMARY

The present disclosure relates generally to evaporator assemblies and, in particular, to air inlets for evaporator assemblies.

The disclosed technology can include an evaporator assembly comprising a housing defining and interior chamber, an air inlet, an air outlet, and an evaporator unit within the interior chamber. The air inlet can have a substantially semi-circular cross section through which air enters the interior chamber. Air entering the interior chamber can transfer heat with the evaporator unit before flowing out of the air outlet.

The straight edge of the semi-circular air inlet can have a length from approximately 10 in to approximately 15 in. The air inlet can also be included in a top pan which defines a top side of the interior chamber. The top pan can be configured to engage a top end of the evaporator assembly. The air inlet can also include a grille.

The air outlet can be positioned on a side of the evaporator assembly. The air outlet can be configured such that an air flow path extends between the air inlet and the air outlet. The evaporator unit can be positioned in the air flow path, thereby creating a cross flow across the evaporator unit. The velocity magnitude of air flowing from the air inlet to the air outlet, particularly the air in contact with the evaporator unit, can deviate less than approximately 0.1 m/s across the exposed surface area of the evaporator.

Also disclosed herein are heat pump systems comprising the same. The heat pump systems can also comprise a condenser unit, a compressor, and a thermal expansion valve, all of which can form a fluid circuit. The fluid circuit can flow a heat transfer fluid therethrough.

The disclosed technology can also include a method of modeling an evaporator assembly. The method can comprise calculating a pressure drop across the evaporator assembly, modelling the evaporator assembly as a solid block comprising a porous medium, simulating a simulated air flow beginning at an air inlet and interacting with the solid block, and calculating a heat transfer coefficient for the evaporator assembly based at least partially on the simulated air flow. The porous medium can have characteristics such that the solid block creates a pressure drop corresponding to the pressure drop of the evaporator assembly.

The method can also maximize the heat transfer coefficient by modifying (or, depending on project constraints, restricting modification of) one or more of: an air flow rate, an air temperature, a size of the air inlet, a location of the air inlet, an orientation of the air inlet, a size of the air outlet, a location of the air outlet, an orientation of the air outlet, a porosity of the porous medium, and the volume of the porous medium.

These and other aspects of the present disclosure are described in the Detailed Description below and the accompanying figures. Other aspects and features of examples of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various examples of the disclosure discussed herein. In similar fashion, while examples may be discussed below as device, system, or method examples, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1:
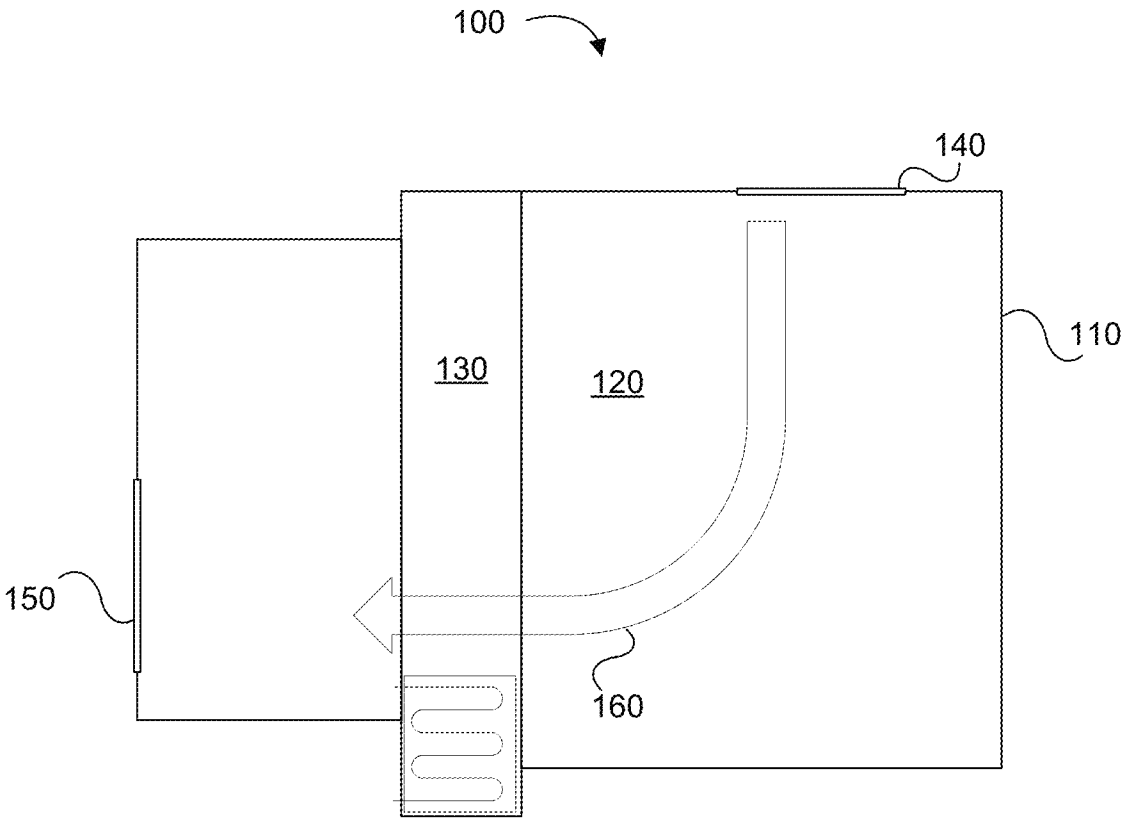
FIG. 1 illustrates a front cross-sectional view of an evaporator assembly in accordance with the present disclosure.

As described above, a problem with current water heaters is that ambient air entering heat pump units, such as in the evaporator unit, is not evenly distributed across the heat exchanger. The fluid dynamics of current air inlets tend to cause turbulent flow, air recirculation, vortices, and other disruptive flow patterns. As a result, the amount of air contacting the heat pump working fluid is typically uneven, ineffective, or both. This can reduce the heat transfer coefficient of the heat exchanger and the overall efficiency of the heat pump, causing the system to waste additional time and energy to provide the necessary heat transfer.

Disclosed herein are heat pump units and evaporator assemblies for water heaters that can provide improved air flow, heat transfer, and overall efficiency. Such units can have semi-circular air inlets, which can guide air such that it flows freely and smoothly into contact with a heat transfer unit, such as an evaporator. Such air inlets can improve the smoothness of air flow and more evenly distribute air flow in contact with the evaporator. Not only can the even air flow improve the heat transfer coefficient of the evaporator, but the even air flow can do so while using less air. With the improved air inlet, the heat pump unit can provide the same or similar amount of heat transfer while intaking air at a lower volumetric flow rate as compared to traditional systems, thus reducing the energy consumption of the unit while also improving the efficiency of the unit.

While the present disclosure is described relating to heat pump units for water heaters and evaporators for heat pump units, it is understood that the technology described herein is not so limited. Indeed, unless otherwise explicitly stated, the present disclosure can be used in conjunction with any heat transfer unit configured to transfer latent heat (e.g., an evaporator or a condenser), sensible heat (a heat exchanger, a heater, or a chiller), or both from air to another working fluid. Additionally, unless otherwise explicitly stated, the present disclosure is not limited to use in water heating applications and can be used in heat pumps for any application.

Although certain examples of the disclosure are explained in detail, it is to be understood that other examples and applications are contemplated. Accordingly, it is not intended that the disclosure is limited in its scope to the details of construction and arrangement of components set forth in the following description or illustrated in the drawings. Other examples of the disclosure are capable of being practiced or carried out in various ways. Also, in describing the disclosed technology, specific terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

As used herein, the term "deviates approximately," "deviates by," and variations thereof are intended to refer to the absolute value of a difference between a given value and a deviation. In other words, a given value X deviating by approximately Y can be rewritten as X±Y.

Reference will now be made in detail to examples of the disclosed technology, some of which are illustrated in the accompanying drawings. Wherever convenient, the same references numbers will be used throughout the drawings to refer to the same or like parts.

FIG. 1 illustrates a cross-sectional component diagram of an evaporator assembly 100 for a heat pump unit. As shown, the evaporator assembly 100 can comprise a housing 110. The housing 110 can include a top pan of a water heater. The housing 110 can be of various sizes and can define an interior chamber 120 inside of which certain components of the evaporator assembly 100 (or the heat pump unit) can be housed. One such component housed within the interior chamber 120 can include an evaporator unit 130. The evaporator unit 130 can be or include a heat exchanger configured to conduct a heat exchange between air in the interior chamber 120 and a working fluid flowing through the evaporator unit 130. The heat exchanged by the evaporator unit 130 can be latent heat (e.g., heat to change the phase of working fluid from liquid to vapor), sensible heat (e.g., heat to change the temperature of the working fluid), or a combination thereof.

The evaporator assembly 100 can have an air inlet 140 which can be an aperture in the housing 110 allowing air to flow from the external environment into the interior chamber 120. The evaporator assembly 100 can also include an air outlet 150 which can be another aperture in the housing 110 allowing air to flow out of the interior chamber 120. The air outlet 150 can lead the air back out to the external environment or into other chambers and components of a water heater.

The air inlet 140 can be positioned on a top side of the evaporator assembly 100, as shown. Such a top side can be referred to as a "top pan" that engages the evaporator assembly 100. The top pan can also define the top side of the interior chamber 120 if the top side is not already defined by the housing 110. The air outlet 150 can be positioned on a side of the evaporator assembly 100, as shown.

The air inlet 140 and the air outlet 150 can form an air flow path 160 along which air entering the evaporator assembly 100 flows from the air inlet 140 to the air outlet 150. The evaporator unit 130 can be positioned within the air flow path 160 to ensure that flowing air contacts the evaporator unit 130 to transfer heat. Increasing the average velocity along the air flow path 160, and therefore across the heat exchanger, can increase the Reynolds number of the air in contact with the evaporator unit 130. Without wishing to be bound by any particular scientific theory, increasing the Reynolds number of the air in contact with the evaporator unit 130 can increase the heat transfer coefficient of the evaporator unit 130.

Alternatively, if the air along the air flow path 160 is disrupted or uneven, the Reynolds number will decrease, thus decreasing the heat transfer coefficient of the evaporator unit 130. While uneven flow may result in higher local air velocities in certain locations along the evaporator unit 130, due to turbulence and air recirculation, others locations along the evaporator unit 130 can receive very little air flow and/or air flow having a low local air velocity, resulting in the total average air velocity along the evaporator unit 130 being lower than the higher local air velocities. Thus, there is an opportunity for improvement in the heat transferability of evaporator units in heat pumps. It is desirable to improve the air velocity distribution to thereby increase the Reynolds number of the air contacting the evaporator unit, as shown in Equation 1:

$$Re = \frac{\rho u L}{\mu} = \frac{uL}{\nu} \tag{1}$$

where Re is the Reynolds number, ρ is the fluid density, u is the fluid flow speed, L is the characteristic length, μ is the dynamic viscosity of the fluid, and ν is the kinematic viscosity of the fluid.

In the case of air flowing along the air flow path 160 and contacting the evaporator unit 130, the average heat transfer coefficient for the evaporator unit can be calculated using Equation 2 for laminar flow and Equation 3 for turbulent flow. Laminar flow can be obtained with a Reynolds number at or below 2000, and turbulent flow can be obtained with a Reynolds number at or above 13000.

$$\bar{h}_{L-x_0} = \left(\frac{k}{L-x_0}\right) 0.664 Re_L^{\frac{1}{2}} Pr^{\frac{1}{3}} \left[1 - \left(\frac{x_0}{L}\right)^{\frac{3}{4}}\right]^{\frac{2}{3}} \tag{2}$$

$$\bar{h}_{L-x_0} = \frac{0.037 Re_L^{\frac{4}{5}} Pr^{\frac{3}{5}} \left[1 - \left(\frac{x_0}{L}\right)^{\frac{9}{10}}\right]^{\frac{8}{9}} k}{L-x_0} \tag{3}$$

As used in Equations 2 and 3, $\bar{h}_{L-x_0}$ represents the average heat exchange coefficient over the characteristic length of the heat exchanger, L is the characteristic length, $x_0$ is the start of the characteristic length, Pr is the Prandtl number, and k is the thermal conductivity of the fluid, in this case air.

As shown, the relationship between the average heat transfer coefficient, $\bar{h}_{L-x_0}$, and the Reynolds number, Re, is proportional. Furthermore, it can be seen that, for laminar flow (Equation 2), the Reynolds number has a greater effect over the average heat transfer coefficient compared to the effect of the Reynolds number under turbulent flow (Equation 3). Consequently, because the average heat transfer coefficient also has a proportional relationship with the rate of heat transfer ($\dot{Q}$) as shown in Equation 4, it follows that increasing the Reynolds number of the air flow path 160 can also increase the rate of heat transfer of the evaporator unit 130.

$$\dot{Q} = hA\Delta T \tag{4}$$

As shown, $\dot{Q}$ represents the heat transfer rate, h represents the average heat transfer coefficient, and ΔT represents the temperature difference of the air between the air inlet 140 and the air outlet 150. Additionally, as illustrated by Equation 4, the rate of heat transfer of the evaporator unit 130 can also be increased by increasing the heat transfer area (A). The heat transfer area can decrease if the air flow path 160 comprises flow disruptions, such as recirculation or vortices.

Figure 2:
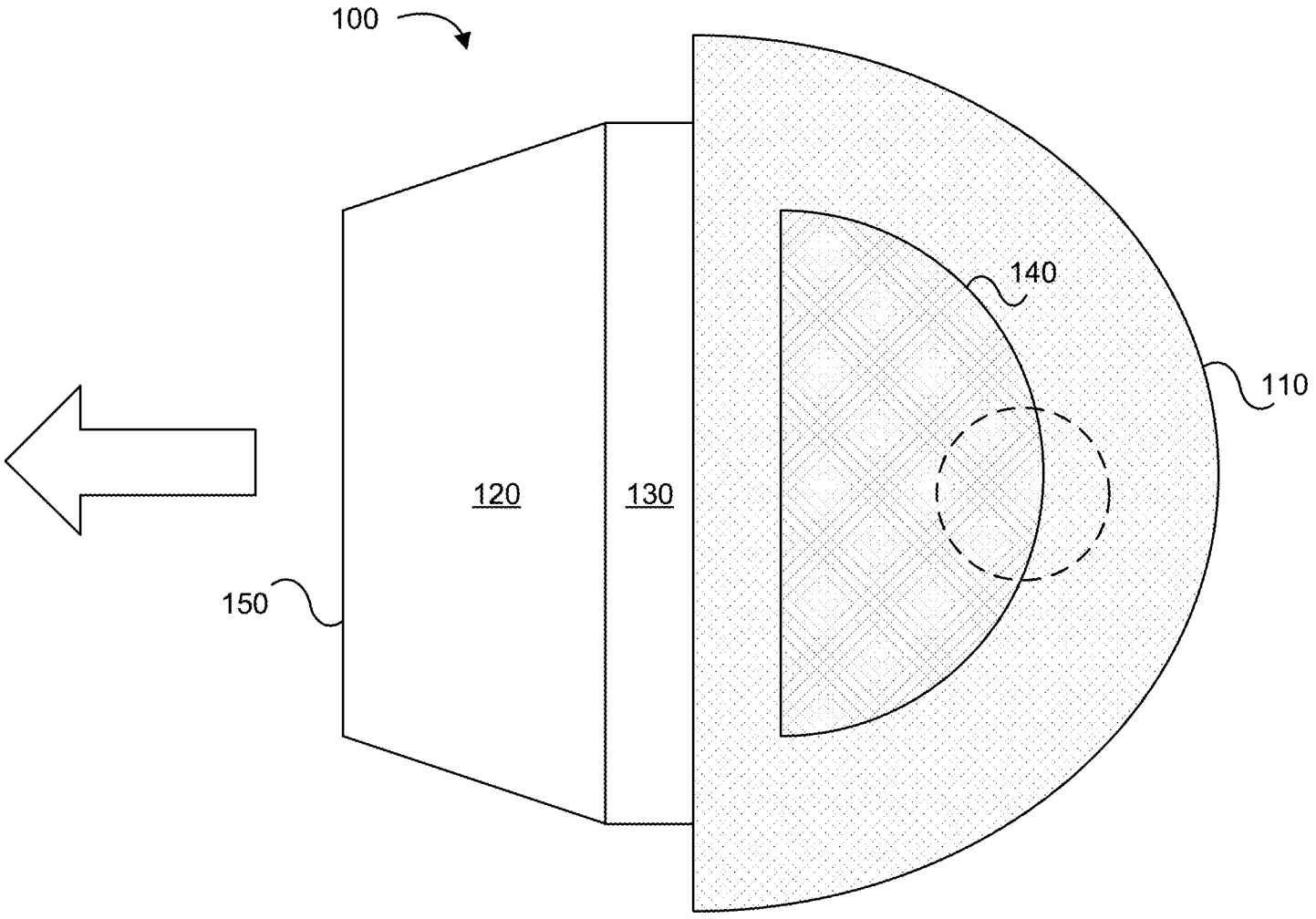
FIG. 2 illustrates a top-down cross-sectional view of an evaporator assembly in accordance with the present disclosure.
Figure 3:
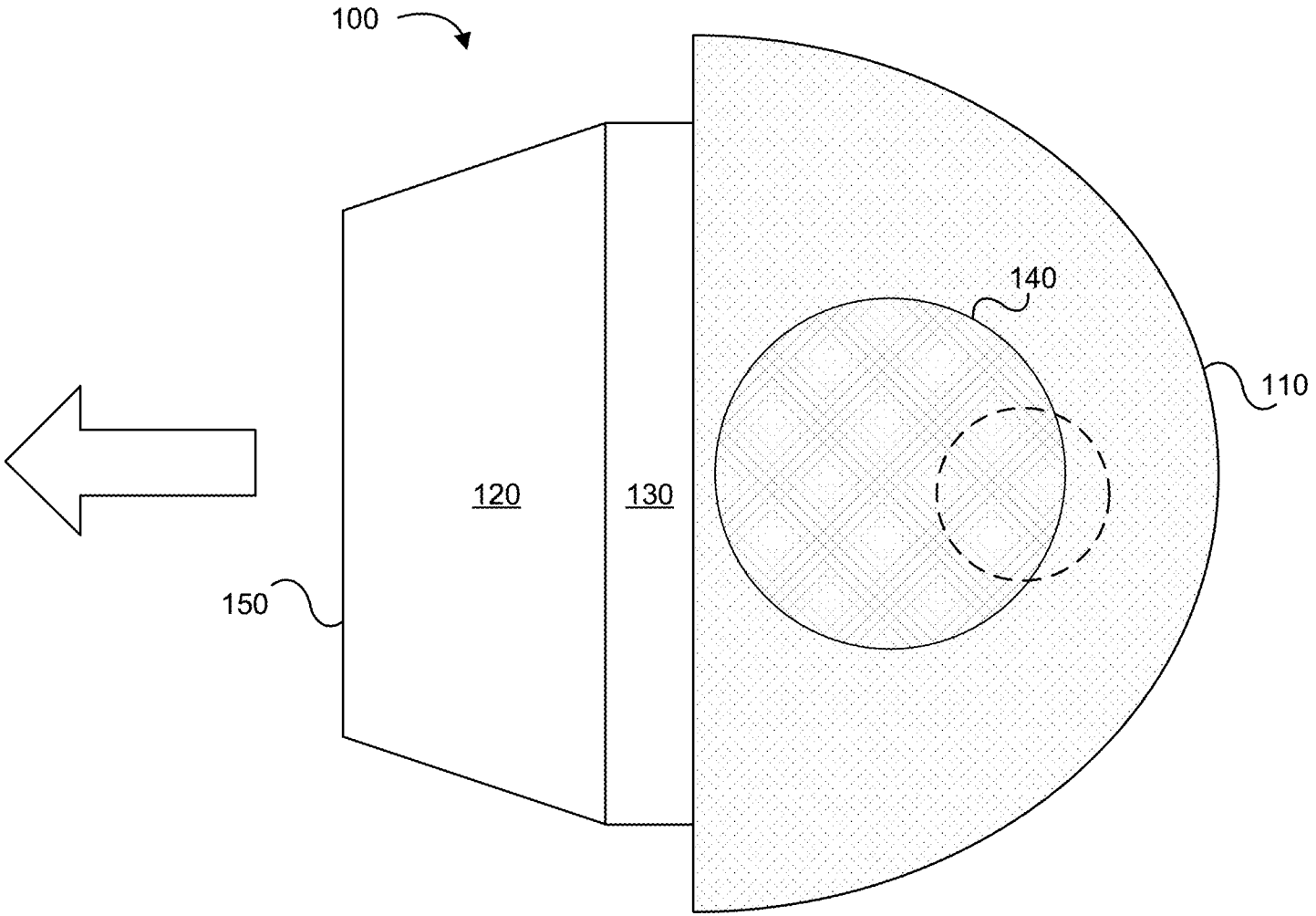
FIG. 3 illustrates a top-down cross-sectional view of another evaporator assembly in accordance with the present disclosure.

FIG. 2 illustrates a top-down cross-sectional view of the evaporator assembly 100 showing the air inlet 140. Compared to the designs having a circular air inlet 140 such as the one shown in FIG. 3, the presently disclosed air inlet 140 design shown in FIG. 2 has a semi-circular profile. The air inlet 140 can have a straight edge 210 and a curved edge 220. Although the air inlet 140 is described herein as being semi-circular, it is not required that the radius of the curved edge 220 be such that the curbed edge forms half of a perfect circle. Rather, the curved edge 220 can be any length or radii that intersects with the straight edge 210 at two points.

It is to be understood that the air inlet 140 described herein can have shapes other than those shown and expressly described with respect to FIG. 2. For instance, the air inlet 140 can be trapezoidal, pentagonal, triangular, or have any number of sides that need not be equidistant. Furthermore, the particular air inlet 140 described in FIG. 2 can be modified. For instance, the curved edge 220 need not be a continuously smooth curve. Rather, the curved edge 220 can comprise a plurality of straight-line segments interconnected to form an overall arc. As would be appreciated, increasing the number of straight-line segments in the curved edge 220 can increase the smoothness of the curved edge. The curved edge 220 can also be modified as desired to alter and/or finely tune air flow. For instance, the curved edge 220 can include a variety of scallops, fins, waves, and the like. Likewise, the straight edge 210 need not necessarily be precisely straight, although it can. As alternatives, the straight edge 210 can have a curve (e.g., with less arc than the curved edge 220) and/or can have multiple segments (e.g., multiple straight segments.

The straight edge 210 can have a length from 5 in to 20 in (e.g., from 6 in to 19 in, from 7 in to 18, from 8 in to 17 in, from 9 in to 16 in, or from 10 in to 15 in). The curved edge 220 can have any suitable length to intersect the straight edge 210 at both ends of the straight edge 210.

The air inlet 140 can also include a grille, mesh, or other such protective cover to keep debris out of the air inlet 140 while still allowing for air flow through the air inlet.

The orientation of the air inlet 140 in FIG. 2 is also not intended to be limiting. In fact, the air inlet 140 can be oriented in a number of ways. For example, the straight edge 210 and the curved edge 220 can be flipped opposite to the orientation shown in FIG. 2. Alternatively, the air inlet 140 can be rotated at any angled as desired. The position of the air inlet can also be altered. For instance, the air inlet 140 and the air outlet 150 can be switched (e.g., the air inlet 140 is on a side of the evaporator assembly 100 and the air outlet 150 is on a top surface). The air inlet 140 can also be positioned on any side surface of the evaporator assembly 100 so long as the air outlet 150 is positioned on an opposite side of the evaporator unit 130.

As shown, the semi-circular air inlet 140 can provide air into the interior chamber 120 and through the air flow path 160 that has a more even distribution with fewer instances of recirculation and/or vortices. In such a manner, the air inlet 140 can provide an evenly distributed air profile in the interior chamber 120 that can increase the average velocity of air in contact with the evaporator unit 130 and increase the Reynolds number of the air flow path 160. These increases can thereby increase the heat transfer coefficient of the evaporator unit 130 and the overall efficiency of the evaporator assembly 100.

Figure 4A:
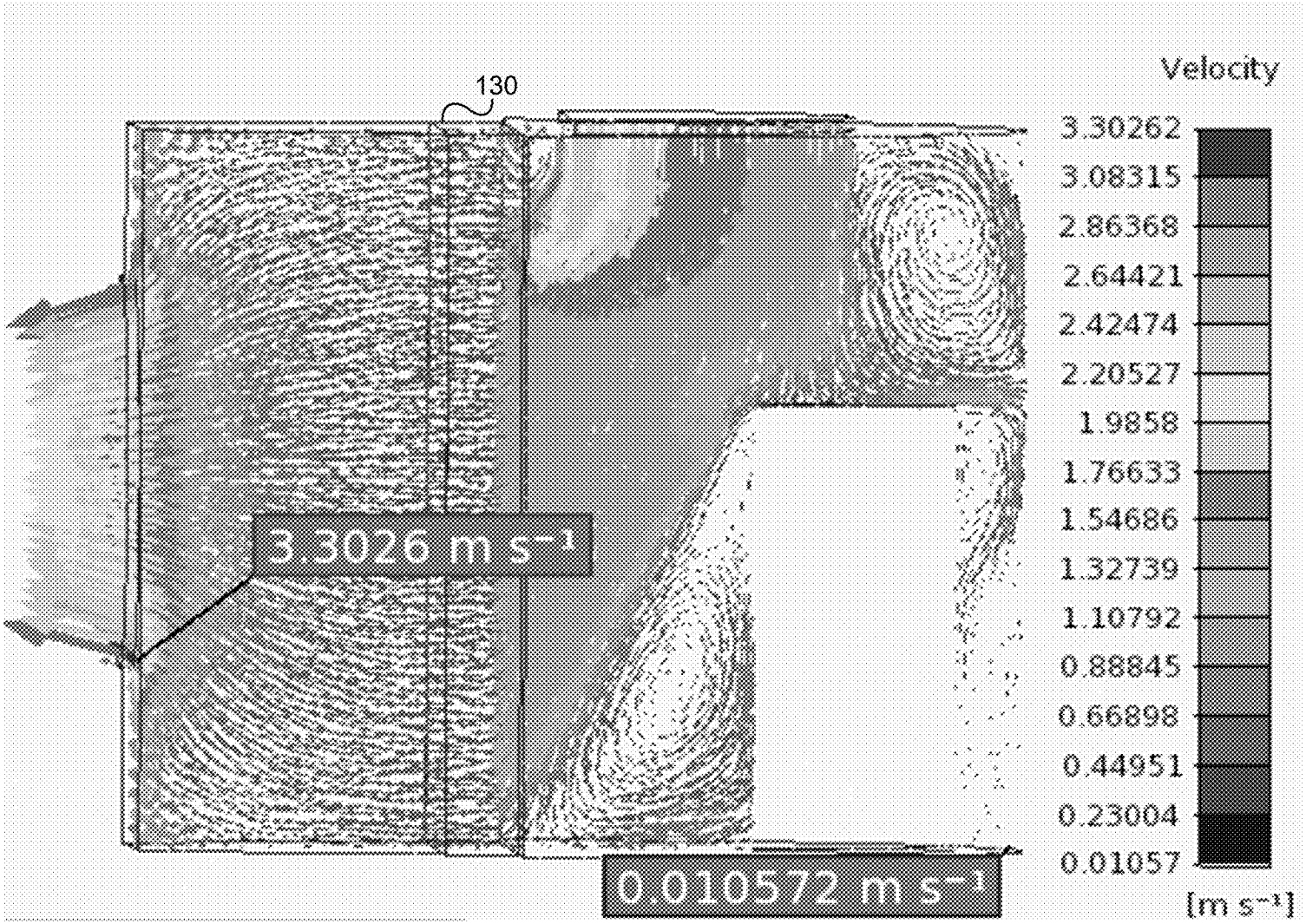
FIG. 4A illustrates a front cross-sectional view of an air flow profile of an evaporator assembly in accordance with the present disclosure.
Figure 4B:
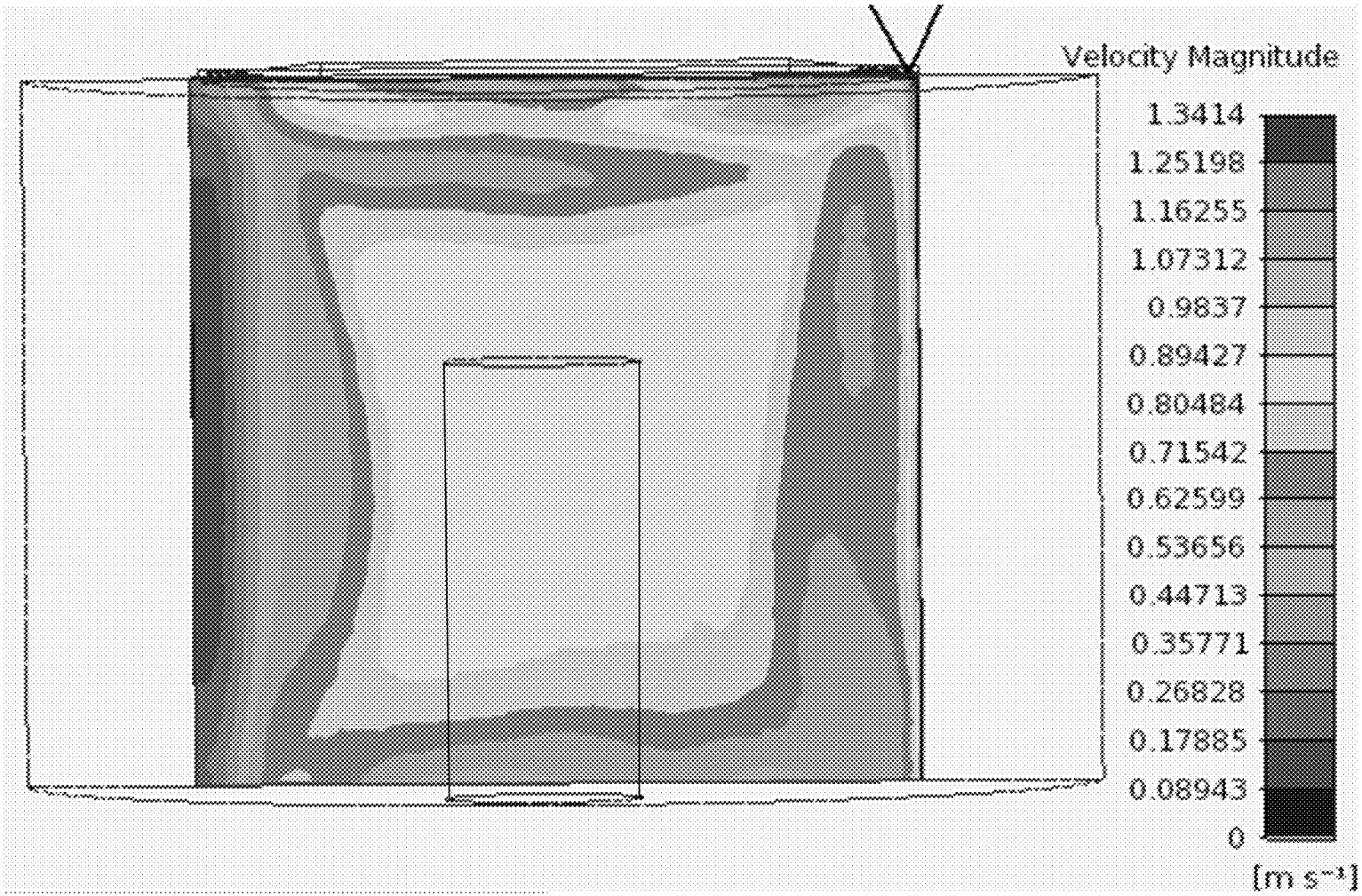
FIG. 4B illustrates a side cross-sectional view of an air flow profile of an evaporator assembly in accordance with the present disclosure.
Figure 4C:
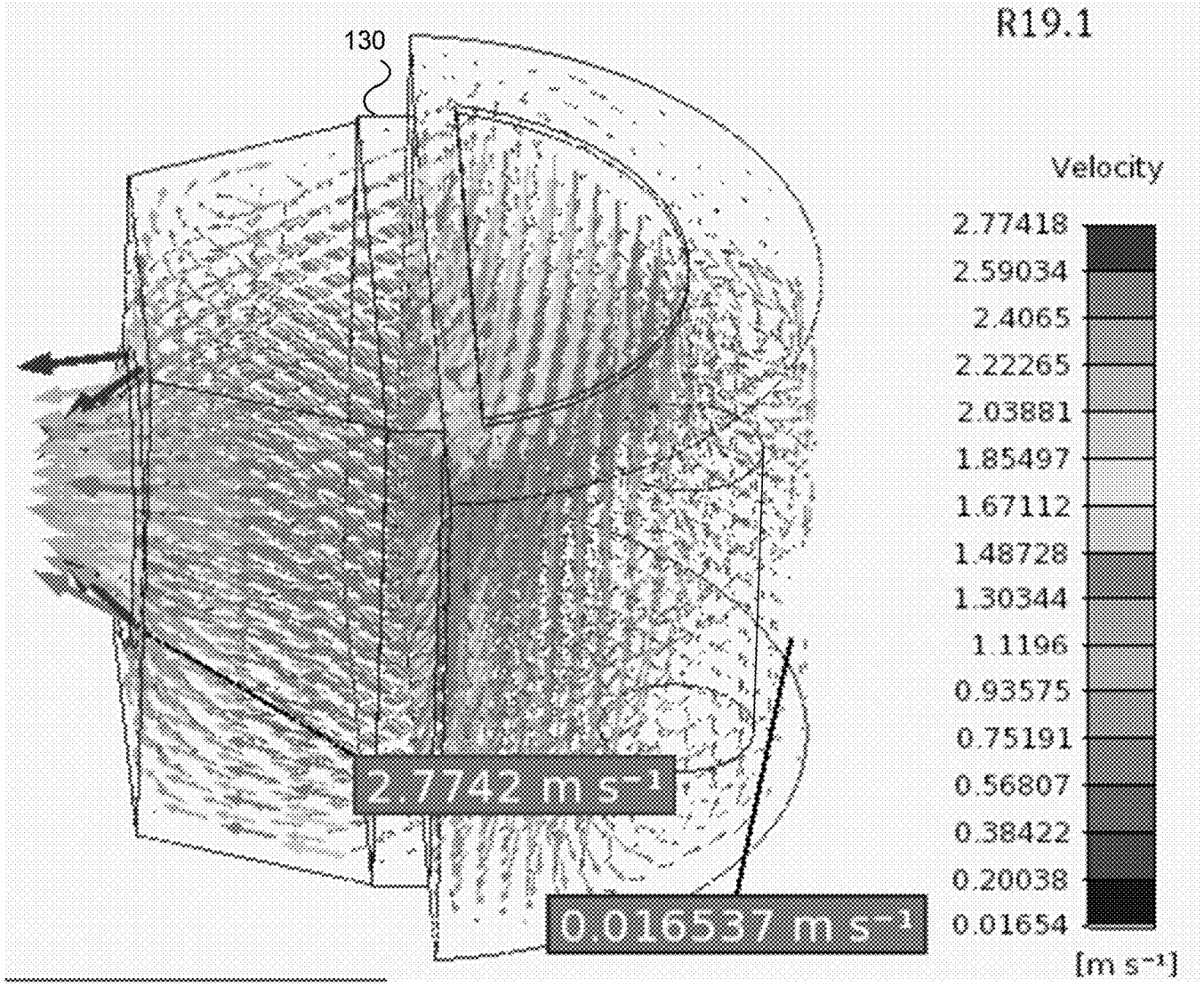
FIG. 4C illustrates an isometric cross-sectional view of an air flow profile of an evaporator assembly in accordance with the present disclosure.

FIGS. 4A and 4B show the air flow profiles from a front cross-sectional view and a side cross-sectional view of the evaporator assembly 100, respectively. Additionally, FIG. 4C illustrates the same air flow profile from an isometric cross-sectional view. As shown, the velocity magnitude surrounding the evaporator unit 130 remains substantially consistent throughout the interior chamber 120.

As shown, the velocity magnitude in the interior chamber 120 can differ by a value of 1 m/s or less (e.g., 0.9 m/s or less, 0.8 m/s or less, 0.7 m/s or less, 0.6 m/s or less, 0.5 m/s or less, 0.4 m/s or less, 0.3 m/s or less, 0.2 m/s or less, or 0.1 m/s or less). Across the surface of the evaporator unit, the velocity magnitude of air in the interior chamber 120 can differ by a value of 0.5 m/s or less (e.g., 0.4 m/s or less, 0.3 m/s or less, 0.2 m/s or less, or 0.1 m/s or less). That is to say, if the average air velocity in the air flow path 160 is, for example, 0.9 m/s, then the velocity magnitude of air at any given point in contact with the evaporator unit 130 can be from 0.4 m/s to 1.4 m/s. In such a manner, the air inlet 140 can achieve uniform and evenly distributed air, thereby increasing the heat transfer coefficient of the evaporator unit 130.

Figure 5A:
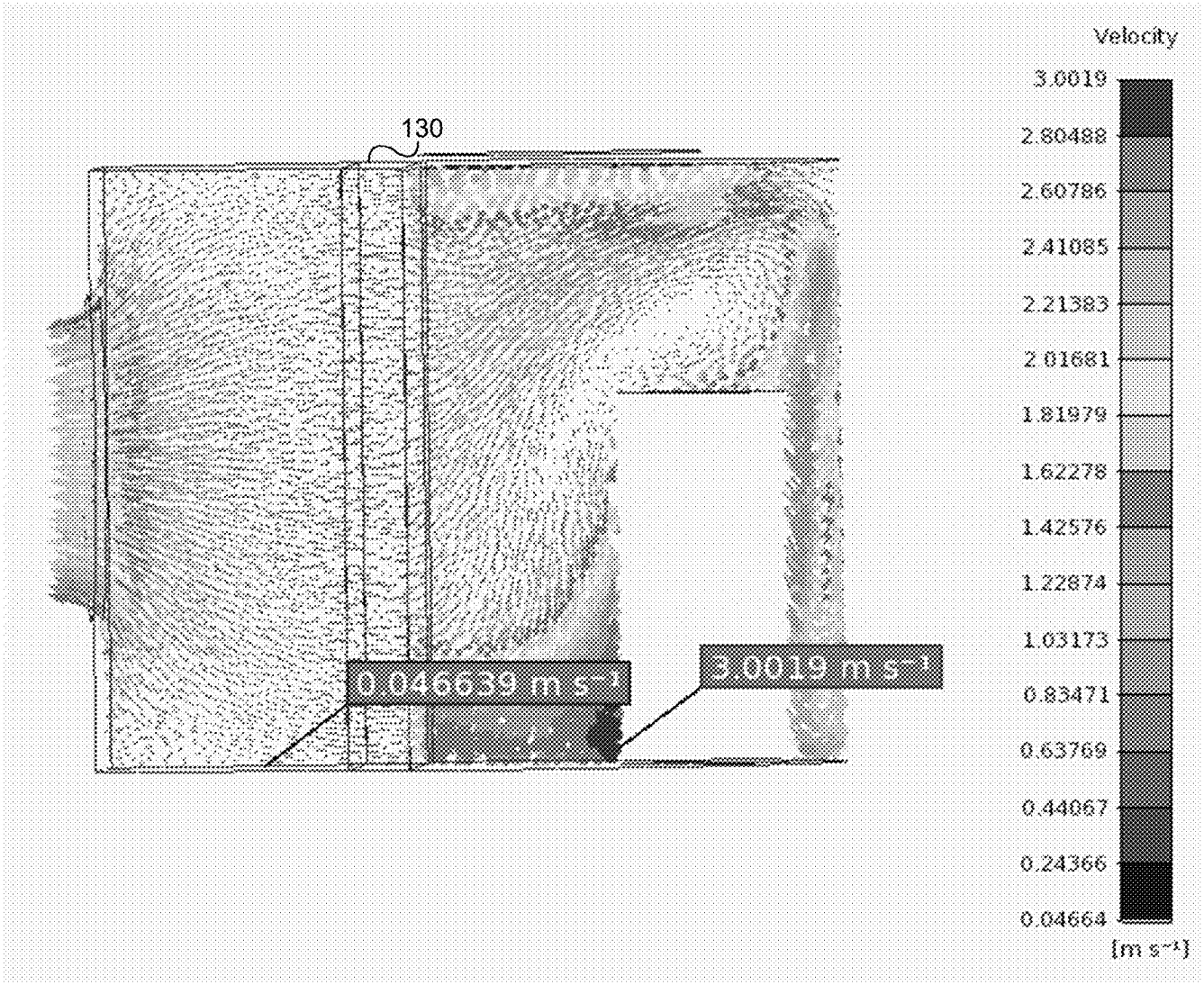
FIG. 5A illustrates a front cross-sectional view of an air flow profile of another evaporator assembly in accordance with the present disclosure.
Figure 5B:
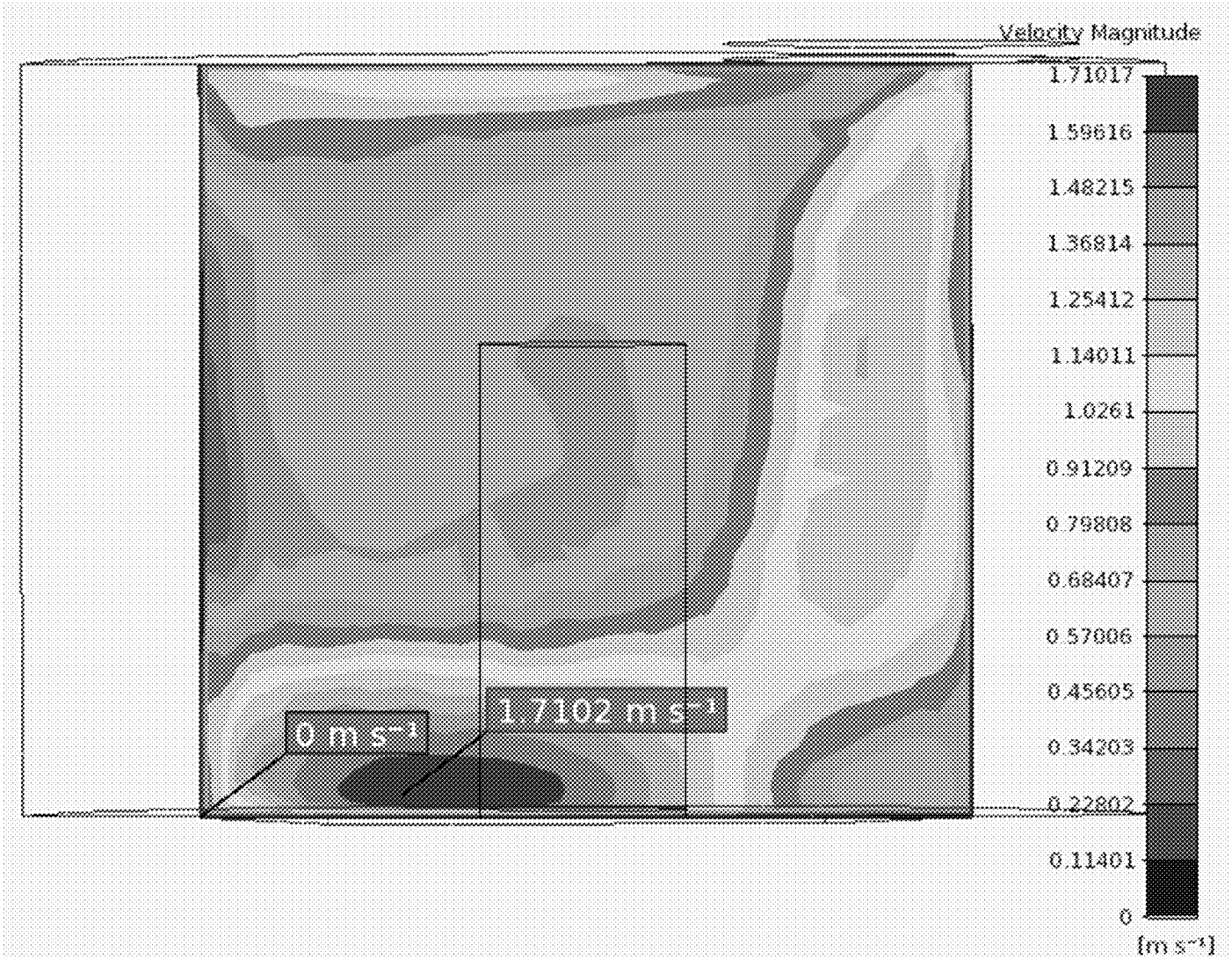
FIG. 5B illustrates a side cross-sectional view of an air flow profile of another evaporator assembly in accordance with the present disclosure.
Figure 5C:
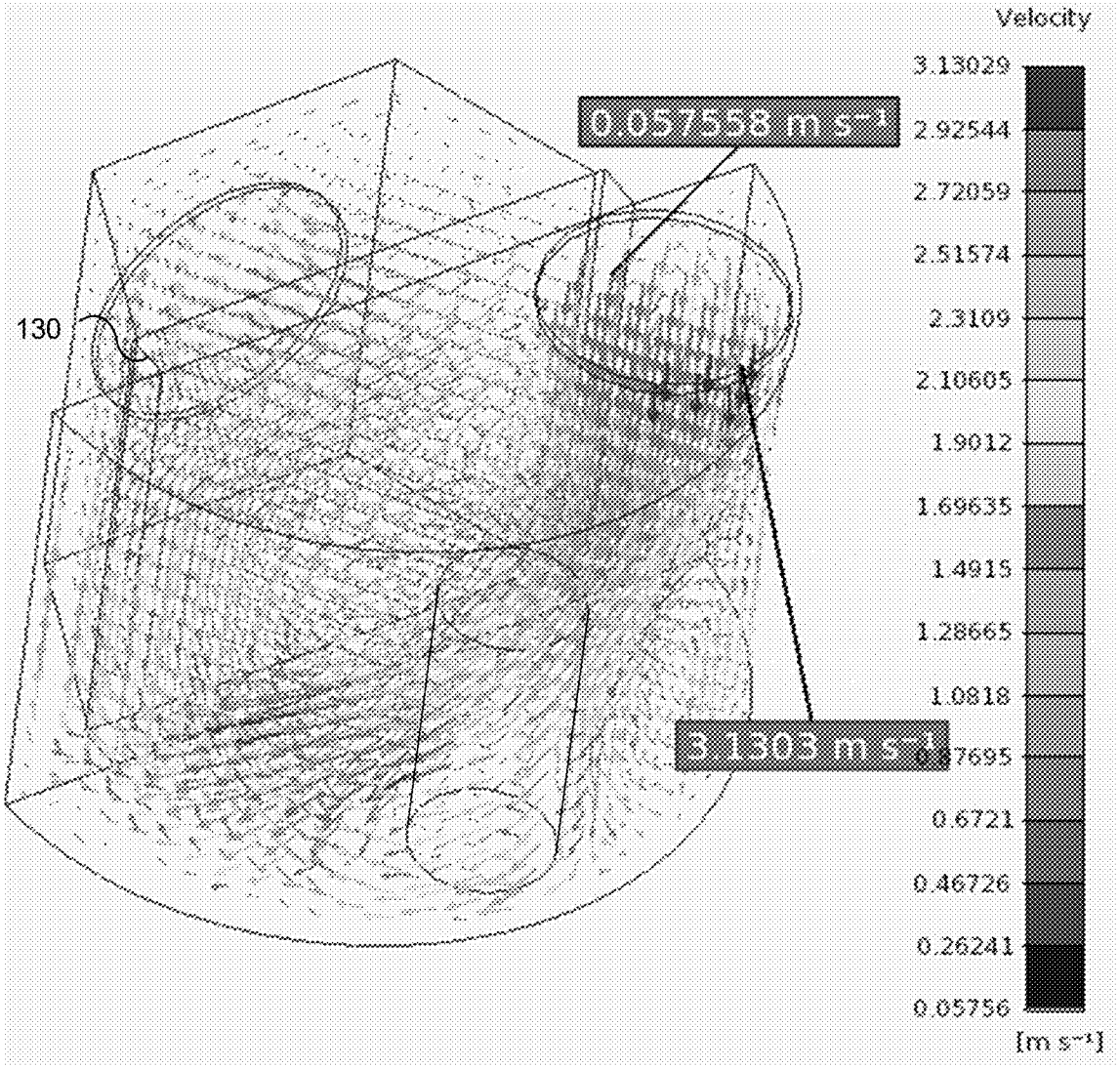
FIG. 5C illustrates an isometric cross-sectional view of an air flow profile of another evaporator assembly in accordance with the present disclosure.

In contrast, the air flow profile for a standard circular air inlet is shown in FIGS. 5A-C. FIGS. 5A and 5B illustrate front and side cross-sectional views, respectively, while FIG. 5C illustrates an isometric cross-sectional view. As shown, the air velocity magnitude in the interior chamber 120 swings wildly. For an average velocity magnitude of 0.7 m/s, the velocity within the interior chamber reaches extremes such as 3 m/s and 0.05 m/s. Both of these extremes occur near the evaporator unit 130. As a result, not only is the average velocity (and therefore the Reynolds number) of the air flow path 160 decreased, but the heat transfer coefficient is also decreased. In contrast, the air inlet 140 in FIGS. 4A-C can see a higher average velocity of 0.9 m/s, thereby increasing the Reynolds number and the heat transfer coefficient.

Figure 6:
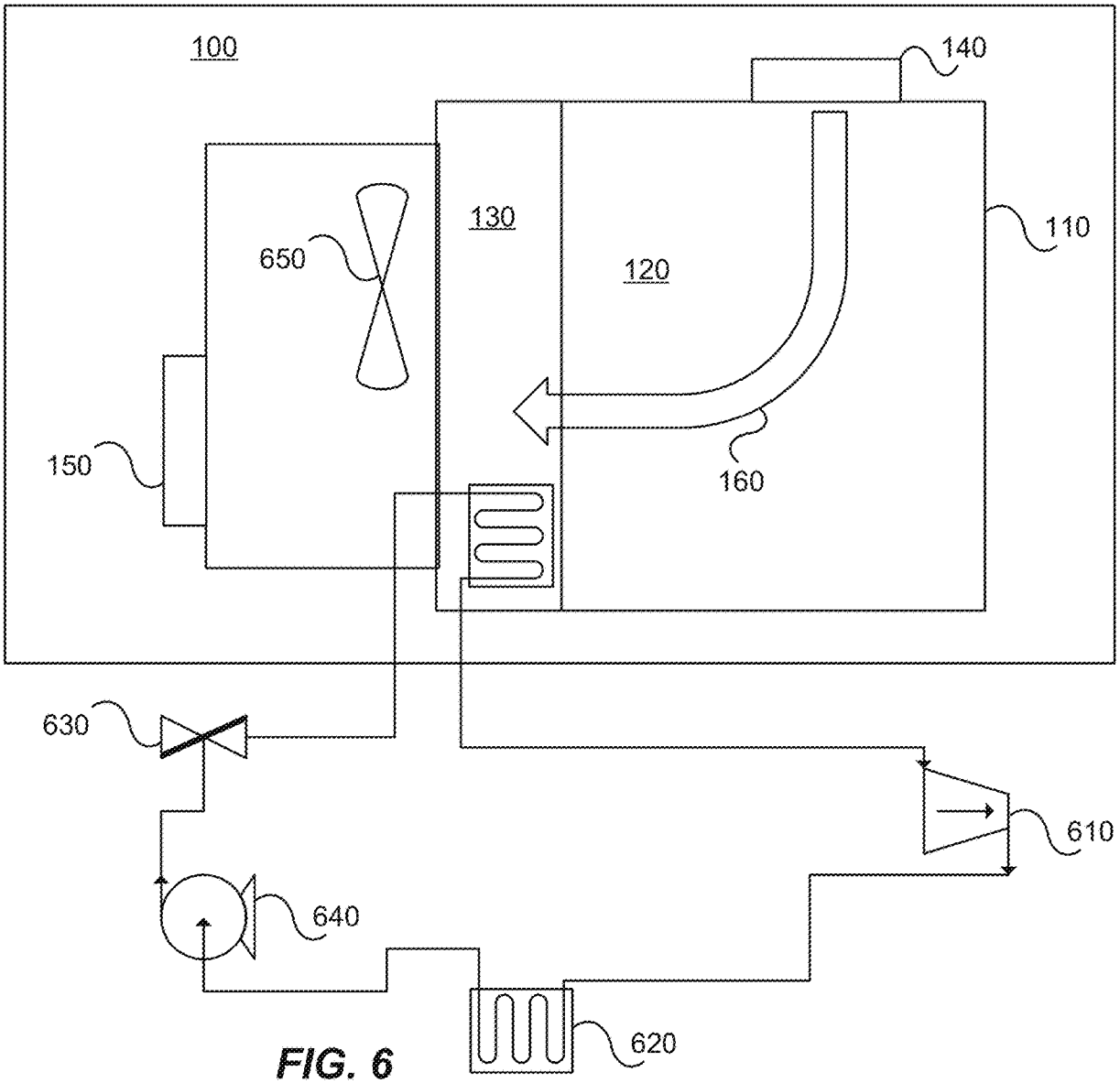
FIG. 6 illustrates a system diagram of an example heat pump system in accordance with the present disclosure.

FIG. 6 illustrates an example heat pump system 600. As shown, the heat pump system 600 can comprise an evaporator assembly 100 (including an evaporator unit 130), a compressor 610, a condenser assembly 620, and a thermal expansion valve 630. The evaporator assembly 100, the condenser assembly 620, the compressor 610, and the thermal expansion valve 630 can form a fluid circuit including various additional pipes, valves, and other fitments. The heat pump system 600 can also include components to encourage fluid flow along the fluid circuit, such as a pump 640, and the heat pump system 600 can also include components to encourage air flow, such as a fan 650. A heat transfer fluid can be configured to flow through the fluid circuit and undergo heat transfer at both the evaporator assembly 100 and the condenser assembly 620.

Also disclosed herein are methods of modelling an evaporator assembly. Although the methods described below are described with respect to the evaporator assembly 100, it is understood that the methods and methodologies described herein can be used to model any evaporator assembly, unless explicitly stated otherwise.

As will be understood by one having skill in the art, modeling heat exchanger systems is commonly accomplished using various computational fluid dynamics (CFD) methods. However, due to the intricate nature of heat exchangers (e.g., due at least in part to the numerous fins attached to the heat exchanger tubes), it is notoriously difficult to construct accurate CFD models of air flowing across a heat exchanger.

Figure 7:
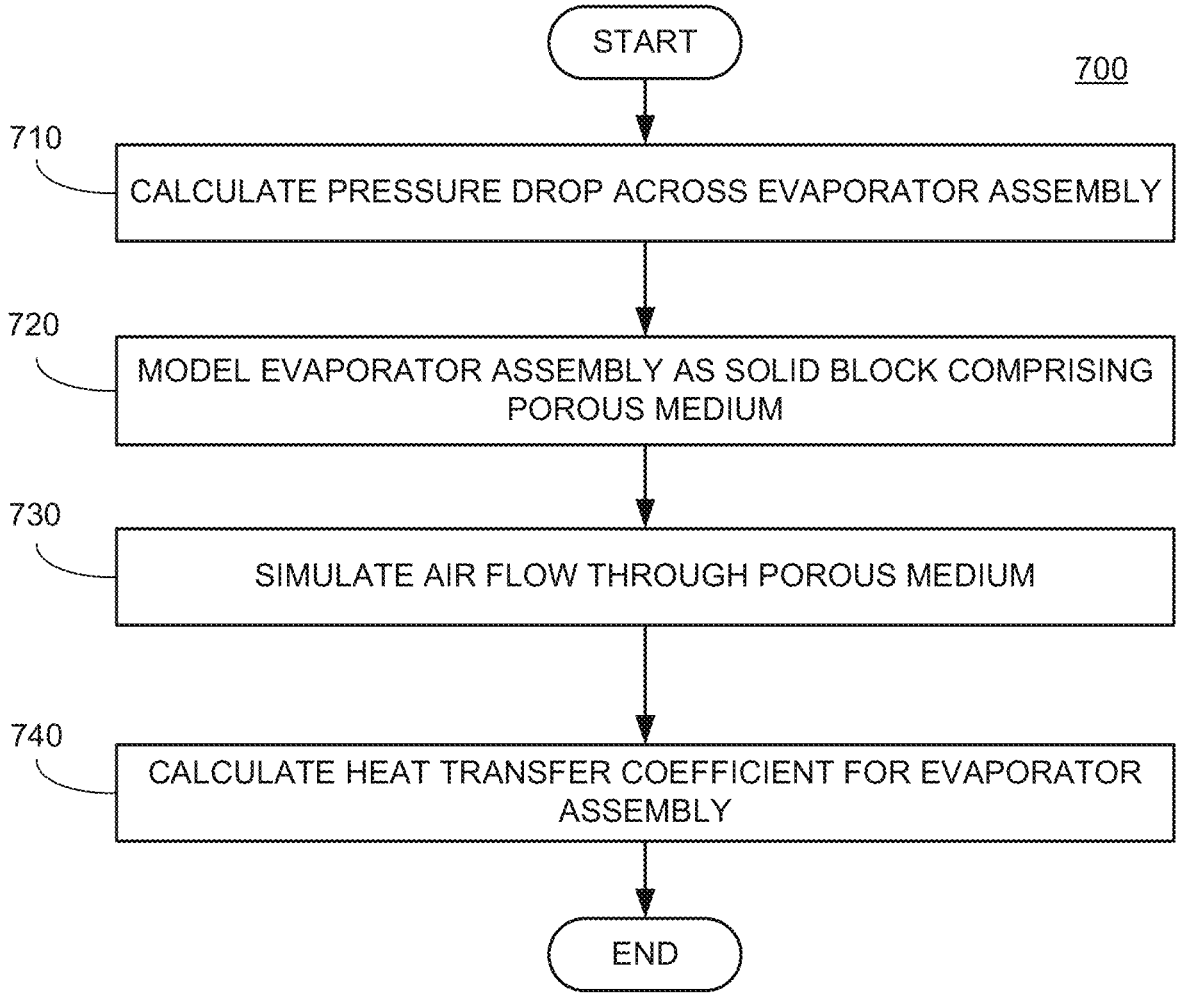
FIG. 7 illustrates a flowchart of a method of modelling an evaporator assembly in accordance with the present disclosure.

FIG. 7 illustrates a method 700 of modelling the evaporator assembly 100. As shown, in block 710, the pressure drop across the evaporator assembly 100 can be calculated. As would be appreciated, the various components within the interior chamber 120 (e.g., the evaporator unit 130), as well as the various fittings and other operational components (e.g., the fan 650) can cause a pressure drop between the air inlet 140 and the air outlet 150. This pressure drop can be further influenced by the size and shape of both the air inlet 140 and the air outlet 150. This pressure drop an influence how the air flow path 160 behaves in the interior chamber 120. The method 700 can then proceed on to block 720.

In block 720, the evaporator assembly 100 can be modeled as a solid block comprising a porous medium. The porous medium can be modified in the CFD model to create a pressure drop corresponding to the calculated pressure drop from block 710. That is, instead of modeling the intricacies of the heat exchanger's fins and other components, the impact of the heat exchanger on air flow can be approximated by using a solid block having the characteristics of a porous medium. The solid block can have dimensions corresponding to a desired size of the evaporator assembly 130. This can ensure that the velocity distribution across the surface area of the solid block is accurately modeled. The method 700 can then proceed on to block 730.

In block 730, the air flow path 160 from the air inlet 140 to the air outlet 150 can be simulated as flowing over and/or through the porous medium. The air flow path 160 can be simulated to model the operating conditions of air flowing through the interior chamber 120 and contacting the evaporator unit 130. To aid in calculating air flow velocities through the air flow path 160, Equation 5 and Equation 6, and Equation 7 can be used.

$$\dot{V} = vA \tag{5}$$

$$\dot{V} = \frac{\dot{m}}{\rho} \tag{6}$$

In Equation 5 and Equation 6, $\dot{V}$ represents the air volumetric flow rate, $v$ represents the flow velocity, $A$ represents the cross-sectional area of the flow, $\rho$ represents the air density, and $\dot{m}$ represents the mass flow rate. The method 700 can then proceed on to block 740.

In block 740, the heat transfer coefficient for the evaporator assembly 100 can be calculated based at least partially on the air flow from block 730. Equation 5 and Equation 6 can be combined to yield Equation 7 to aid in the calculation.

$$\dot{m}=\rho vA \quad (7)$$

Upon obtaining the mass flow rate from the simulation in block 730, the heat transfer rate and/or the heat transfer coefficient can be calculated using Equation 8.

$$\dot{Q}=\dot{m}c\Delta T \quad (8)$$

In Equation 8, $\dot{Q}$ represents the heat transfer rate, c represents the specific heat capacity of air, and $\Delta T$ represents the temperature difference of the air between the air inlet 140 and the air outlet 150. Using the heat transfer rate, any of the preceding equations, such as Equation 4, can be used to calculate the heat transfer coefficient. The method 700 can terminate after block 740 or proceed on to other method steps not shown. For example, the method 700 can then maximize the heat transfer coefficient by modifying (or, depending on project constraints, restricting modification of) one or more of: an air flow rate, an air temperature, a size of the air inlet, a location of the air inlet, an orientation of the air inlet, a size of the air outlet, a location of the air outlet, an orientation of the air outlet, a porosity of the porous medium, and the volume of the porous medium.

While the present disclosure has been described in connection with a plurality of example aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

EXAMPLES

An evaporator can have an 11-inch long semi-circular air inlet with a grille in the top pan of a heat pump system. The heat pump system can be sized for a 50-gallon water heater. Upon flowing air through the evaporator at a volumetric flow rate of 160 cfm, the average air velocity within the evaporator can be 0.9 m/s. Due to the semi-circular air inlet, the air in contact with the evaporator can differ from no less than 0.6 m/s to no greater than 1.2 m/s.

What is claimed is:

1. An evaporator assembly comprising:

a housing defining an interior chamber;

an air inlet having a substantially semi-circular cross section through which air flows into the interior chamber, the cross section being shaped to maximize a heat transfer coefficient of an evaporator unit based on a computational fluid dynamics (CFD) model;

an air outlet through which air flows out of the interior chamber; and the evaporator unit disposed within the interior chamber such that air flowing through the interior chamber can transfer heat with the evaporator unit, wherein the CFD model accounts for a pressure drop across the evaporator assembly experienced by the air by modeling the evaporator assembly as a solid block comprising a porous medium.

2. The evaporator assembly of claim 1 further comprising a top pan configured to engage a top end of the evaporator assembly, wherein the top pan comprises the air inlet.

3. The evaporator assembly of claim 2, wherein the top pan defines a top side of the interior chamber.

4. The evaporator assembly of claim 2, wherein the air outlet is positioned on a side of the evaporator assembly.

5. The evaporator assembly of claim 2, wherein the evaporator unit is positioned in an air flow path extending between the air inlet and the air outlet, thereby creating a cross flow across the evaporator unit.

6. The evaporator assembly of claim 1, wherein the air inlet comprises a grille.

7. The evaporator assembly of claim 1, wherein the substantially semi-circular cross section results in a Reynolds number of the air flowing into the interior of the chamber corresponding to laminar flow.

8. The evaporator assembly of claim 7, wherein the CFD model is configured to calculate the heat transfer coefficient using:

$$h_{L-x_0}=\left(\frac{k}{L-x_0}\right)0.664\ \mathrm{Re}_L^{\frac{1}{2}}Pr^{\frac{1}{3}}\left[1-\left(\frac{x_0}{L}\right)^{\frac{3}{4}}\right]^{\frac{2}{3}},$$

where $h_{L-x_o}$ is the heat transfer coefficient, L is a characteristic length, $x_0$ is a start of the characteristic length, Pr is the Prandt1 number, and k is a thermal conductivity of the air.

9. The evaporator assembly of claim 8, wherein the substantially semi-circular cross section of the inlet reduces the pressure drop in the model which increases the average heat transfer coefficient.

10. The evaporator assembly of claim 1, wherein the CFD model is configured to simulate an air flow path from the air inlet to the air outlet as flowing over and/or through the porous medium.

11. The evaporator assembly of claim 10, wherein the CFD model is configured to simulate the air flow path using $$\dot{V}=vA=\frac{\dot{m}}{\rho},$$

where $\dot{V}$ is an air volumetric flow rate, $v$ is a flow velocity, A represents the cross-sectional area of the flow, $\rho$ is an air density, and $\dot{m}$ is a mass flow rate of the air.

12. The evaporator assembly of claim 11, wherein the CFD model is configured to calculate the heat transfer coefficient for the evaporator assembly at least partially based on the air flow path using $\dot{m}=\rho vA$.

13. The evaporator assembly of claim 12, wherein the CFD model is configured to calculate a heat transfer rate using $$\dot{Q}=\dot{m}c\Delta T,$$

where $\dot{Q}$ is the heat transfer rate, c is a specific heat capacity of the air, and $\Delta T$ is a temperature difference of the air between the air inlet and the air outlet.

14. The evaporator assembly of claim 13, wherein the CFD model is configured to calculate the heat transfer coefficient using $$\dot{Q}=hA\Delta T,$$

where h is the heat transfer coefficient.

15. The evaporator assembly of claim 14, wherein the CFD model is configured to:

alter a size, a location, and/or an orientation of the air inlet based on the calculated heat transfer coefficient; and recalculate the heat transfer coefficient based on the altered size, location, and/or orientation of the air inlet.

16. A heat pump system comprising:

an evaporator assembly comprising:

a housing defining an interior chamber;

an air inlet having a substantially semi-circular cross section through which air flows into the interior chamber, the cross section being shaped to maximize a heat transfer coefficient of an evaporator unit based on a computational fluid dynamics (CFD) model;

an air outlet through which air flows out of the interior chamber; and the evaporator unit disposed within the interior chamber such that air flowing through the interior chamber can transfer heat with the evaporator unit, wherein the CFD model accounts for a pressure drop across the evaporator assembly experienced by the air by modeling the evaporator assembly as a solid block comprising a porous medium.

17. The heat pump system of claim 16 further comprising:

a fluid circuit configured to flow a heat transfer fluid through the evaporator unit, the fluid circuit comprising:

a condenser unit;

a compressor; and a thermal expansion valve.

18. The heat pump system of claim 16, wherein the air inlet comprises a grille.

19. The heat pump system of claim 16 further comprising a top pan configured to engage a top end of the evaporator assembly, wherein the top pan comprises the air inlet.

* * * * *